US005809753A

United States Patent [19]

Carney

[11] Patent Number: 5,809,753

[45] Date of Patent: Sep. 22, 1998

[54] TWO PERSON SADDLE TREE AND SADDLE

[76] Inventor: John Carney, 87-A-A, Hwy 63N, Vichy, Mo. 65580

[21] Appl. No.: 866,528

[22] Filed: May 30, 1997

[51] Int. Cl.[6] ..... B68C 1/02

[52] U.S. Cl. ..... 54/44.1; 54/44.2

[58] Field of Search ..... 54/44.1, 44.2, 54/44.3, 44.7

[56] References Cited

U.S. PATENT DOCUMENTS 4,362,003 12/1982 Robinson ..... 54/44.1

*Primary Examiner*—Robert P. Swiatek

*Attorney, Agent, or Firm*—Howell & Haferkamp, L.C.

[57] ABSTRACT

A two-person saddle comprises a saddle tree having a pair of elongate tree bars. A tree fork extends between and up from forward portions of the tree bars. A rear cantle extends between and up from rearward portions of the tree bars, and a front cantle extends between and up from intermediate portions of the tree bars. The front cantle is rearwardly spaced from the tree fork and forwardly spaced from the rear cantle.

20 Claims, 3 Drawing Sheets

TWO PERSON SADDLE TREE AND SADDLE

BACKGROUND OF THE INVENTION

This invention relates to saddles used for horseback riding and, more particularly, to saddles for enabling two riders to simultaneously ride a horse.

Often, it is desirable for two people to ride a horse in tandem, such as when an adult is training a child to ride. Existing saddles used for training or riding in tandem have proven unsatisfactory. Generally, these saddles include a small training saddle removably attached to the horn of a full-size saddle. Such saddles do not enable the student to obtain a true sense of riding as is obtained by riding a primary saddle. Such saddles are also susceptible to failure because the training saddle might become detached from the primary saddle during riding. These saddles also might not properly distribute the weight of the riders on the horse and thereby cause irritation to the horse.

Another type of saddle includes a rear primary seat portion and a forward auxiliary seat portion integral with the primary seat portion. This type of saddle enables two people to ride in tandem. However, such saddle does not use a saddle tree and therefore does not adequately distribute the weight of the riders on the horse.

SUMMARY OF THE INVENTION

Among the several objects of the present invention may be noted the provision of an improved two-person saddle; the provision of such a saddle configured for a proper positioning on a horse; the provision of such a saddle configured to provide comfort to the riders; the provision of such a saddle configured to properly fit a horse and thereby minimize irritation to the horse; the provision of such a saddle configured to properly distribute the weight of the riders on the horse; and the provision of such a saddle having a saddle tree configured for accommodating two riders.

In general, a two-person saddle of the present invention comprises a saddle tree having a pair of elongate tree bars. A tree fork extends between and up from forward portions of the tree bars. A rear cantle extends between and up from rearward portions of the tree bars, and a front cantle extends between and up from intermediate portions of the tree bars. The front cantle is rearwardly spaced from the tree fork and forwardly spaced from the rear cantle.

Another aspect of the present invention is a saddle tree for a two person saddle. The saddle tree comprises a pair of elongate tree bars, a tree fork extending between and up from forward portions of the tree bars, a rear cantle extending between and up from rearward portions of the tree bars, and a front cantle extending between and up from intermediate portions of the tree bars. The front cantle is rearwardly spaced from the tree fork and forwardly spaced from the rear cantle.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
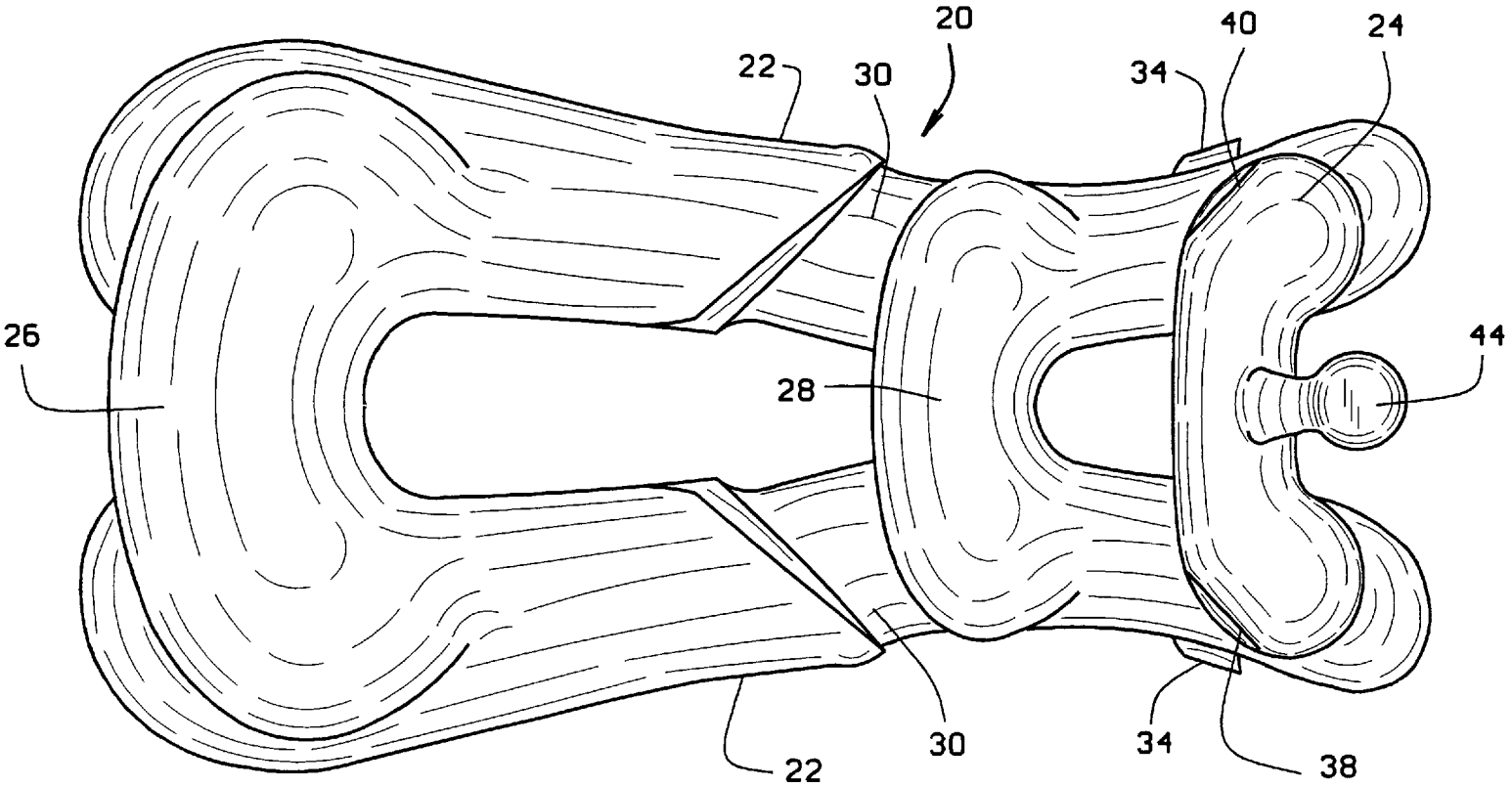
FIG. 1 is a top plan view of a saddle tree for a two-person saddle of the present invention.

Referring now to the drawings, and first more particularly to FIG. 1, a saddle tree of the present invention is indicated in its entirety by the reference numeral 20. The saddle tree 20 is shaped and configured for making a two-person saddle. The saddle tree comprises a pair of elongate tree bars 22, a tree fork 24, a rear cantle 26, and a front cantle 28. The tree fork 24 extends between and up from forward portions of the tree bars 22. The rear cantle 26 extends between and up from rearward portions of the tree bars 22. The front cantle 28 extends between and up from intermediate portions of the tree bars 22. The front cantle 28 is rearwardly spaced from the tree fork 24 and forwardly spaced from the rear cantle 26. Braces 29 extend up from the tree bars 22 and are secured to the rear of the front cantle 28 for supporting the front cantle.

The tree fork 24 is positioned closer to the front edges of the tree bars 22 than are the tree forks of conventional saddle trees. Preferably, the tree fork 24 is positioned approximately one-half inch from the front edges of the tree bars 22. The rear cantle 26 is positioned closer to the rear edges of the tree bars 22 than are the cantles of conventional saddle trees. Preferably, the rear cantle 26 is spaced approximately 1.25" from the rear edges-of the tree bars 22. Positioning the tree fork 24 and rear cantle 26 in this manner provides the proper spacing needed to accommodate two riders. Also, positioning the rear cantle 26 close to the rear edges of the tree bars 22 shifts the weight of the rear rider rearward on the horse so that the center of gravity of the combined riders is approximately at the same position on the horse as would be the center of gravity of a single rider using a conventional saddle.

Figure 2:
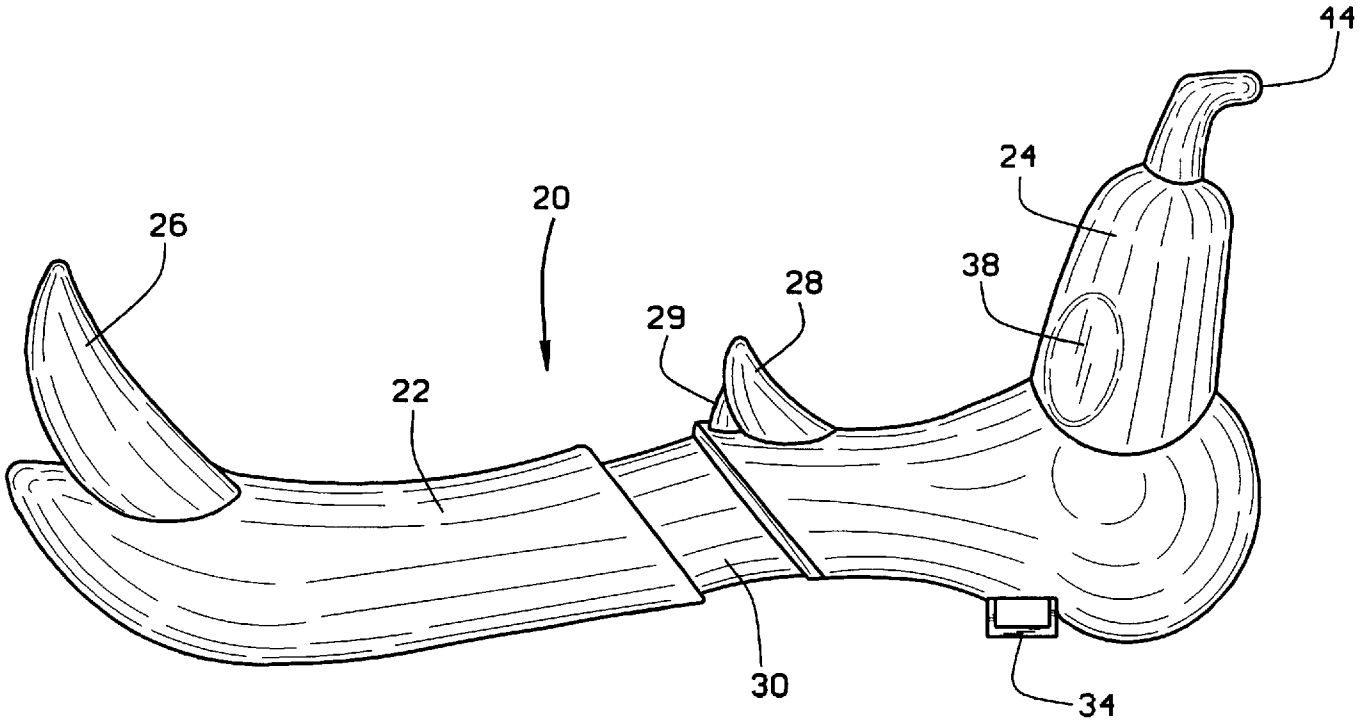
FIG. 2 is a side elevational view of the saddle tree of FIG. 1.

Each tree bar 22 has a recessed (or notched) region 30 generally rearward of the front cantle 28. The recessed regions 30 are configured for receiving rear stirrup leathers, generally indicated at 32 (see FIG. 3). More particularly, the recesses of the recessed regions 30 (FIGS. 1 and 2) preferably slant downward and forward for receiving forward angled stirrup leathers for the rear rider's legs. Rings 34 are secured to the tree bars 22 generally forward of the front cantle 28. The rings 34 constitute stirrup receiving connectors configured for connecting forward stirrup leathers, generally indicated at 36 (see FIG. 3), to the tree bars. Preferably, the tree fork 24 includes first and second side recessed regions 38, 40 for accommodating the legs of the front rider, i.e., a rider sitting between the front cantle 28 and tree fork 24. These recessed regions 38, 40 reduce the amount by which a child rider must spread his or her legs. Preferably, the tree fork 24 includes a 2 ½" horn cap 44 which accommodates a child's hands while remaining large enough for adult hands.

The saddle tree 20 may be of any suitable material such as a polymeric material, wood, fiberglass, etc. Preferably, the tree bars 22, tree fork 24, and front and rear cantles 28, 26, are of lodgepole pine. After these are assembled together, they are wrapped in rawhide, laced with deer skin, and dipped in polyurethane for water proofing.

Figure 3:
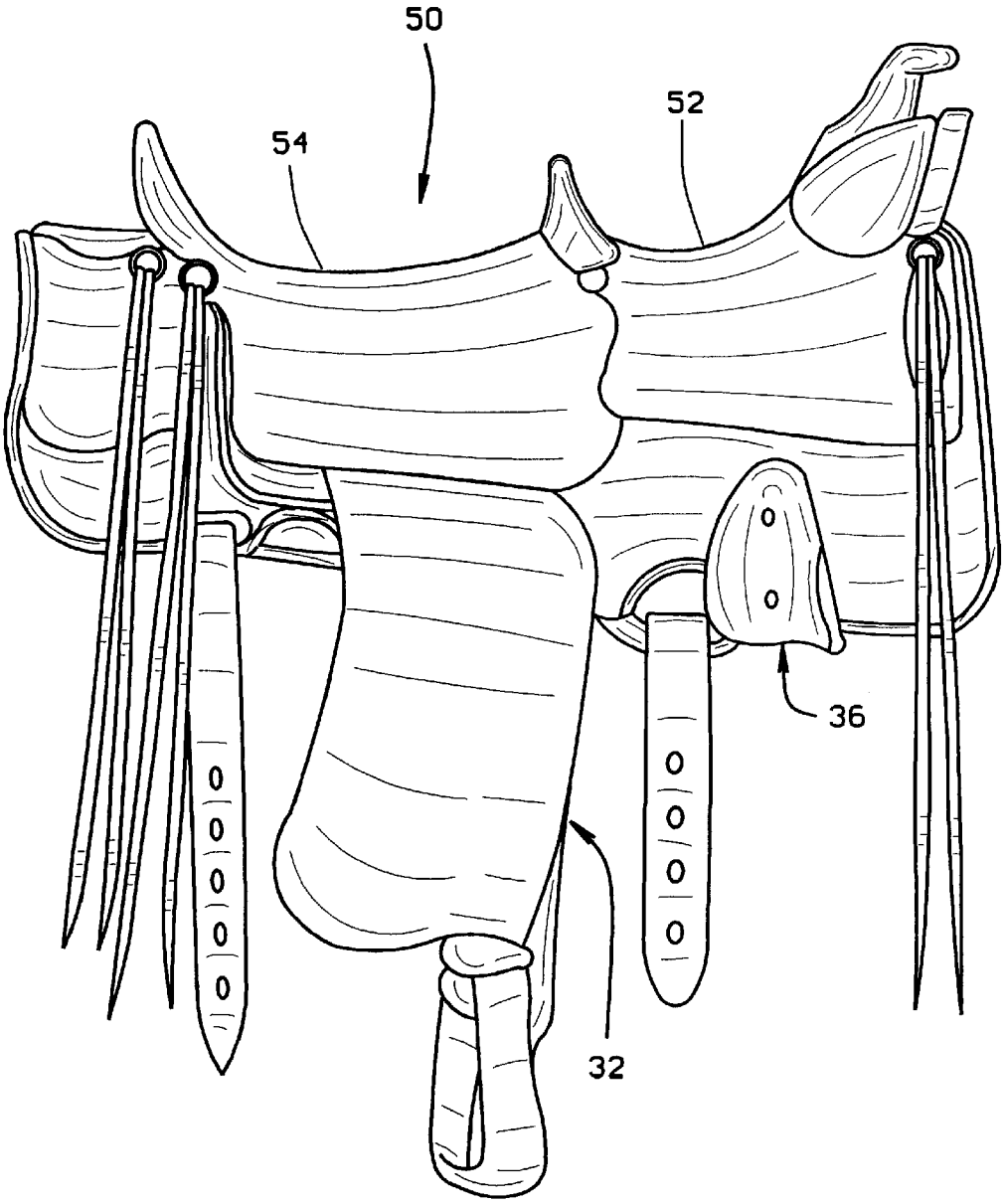
FIG. 3 is a side elevational view of a saddle constructed with the saddle tree of FIGS. 1 and 2.

The saddle of the present invention, incorporating the saddle tree 20, is generally indicated at 50 in FIG. 3. The saddle 50 has full saddle rigging for forward and back girth. The gullet is preferably higher than standard for placing the saddle further up the horses neck. More particularly, the gullet of the saddle 50 is preferably nine inches. The saddle 50 has in-skirt riggings to eliminate all obstructions for the riders' legs. Preferably, the forward seat (child seat) 52 has a ten inch seat length, and the rear seat (adult seat) 54 has a thirteen inch seat length. Although the rear seat 54 has a relatively short length, the short height of the front cantle 28 allows the rear seat to comfortably accommodate an average large adult male. The rear seat 54 has three inch wide stirrup leathers 32 with swing-forward curvature in the fenders to match legs of the rear rider. The forward seat 52 has its own tapideros 58 for receiving the feet of the child rider. Also preferably, the saddle 50 has standard rigging and latigo hangers.

The saddle 50 is preferably constructed with standard tree dimensions so that the saddle distributes the weight of the riders onto four distinct pressure regions on the opposite sides of the horse's back, keeping all direct pressure off the horse's spine. Also, because the gullet is raised higher than a standard gullet, the weight of the two riders is distributed similar to that of a standard tree. Because of the foregoing features, two riders may safely and securely ride a horse in tandem while keeping the horse safe from any weight-distribution-related injury.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A saddle tree for a two person saddle, the saddle tree comprising a pair of elongate tree bars, a tree fork extending between and up from forward portions of the tree bars, a rear cantle extending between and up from rearward portions of the tree bars, and a front cantle extending between and up from intermediate portions of the tree bars, the front cantle being rearwardly spaced from the tree fork and forwardly spaced from the rear cantle.

2. A saddle tree as set forth in claim 1 wherein each tree bar has a recessed region generally rearward of the front cantle, the recessed regions being configured for receiving rear stirrup leathers.

3. A saddle tree as set forth in claim 2 wherein the recessed regions are shaped and configured for receiving angled stirrup leathers.

4. A saddle tree as set forth in claim 2 further comprising stirrup receiving connectors secured to the tree bars generally forward of the front cantle, said stirrup receiving connectors being configured for connecting forward stirrup leathers to the tree bars.

5. A saddle tree as set forth in claim 1 wherein the tree fork includes first and second side recessed regions for accommodating the legs of a rider sitting between the front cantle and tree fork.

6. A saddle tree as set forth in claim 1 wherein said tree bars are of wood.

7. A saddle tree as set forth in claim 6 wherein the tree fork, front cantle, and rear cantle are of wood.

8. A saddle tree as set forth in claim 7 further comprising a rawhide covering over the tree bars, tree fork, front cantle, and rearward cantle.

9. A saddle tree as set forth in claim 8 further comprising a polyurethane coating on the rawhide.

10. A saddle tree as set forth in claim 1 further comprising a rawhide covering over the tree bars, tree fork, front cantle, and rearward cantle.

11. A two-person saddle comprising a saddle tree having a pair of elongate tree bars, a tree fork extending between and up from forward portions of the tree bars, a rear cantle extending between and up from rearward portions of the tree bars, and a front cantle extending between and up from intermediate portions of the tree bars, the front cantle being rearwardly spaced from the tree fork and forwardly spaced from the rear cantle.

12. A two-person saddle as set forth in claim 11 wherein each tree bar has a recessed region generally rearward of the front cantle, the recessed regions being configured for receiving rear stirrup leathers.

13. A two-person saddle as set forth in claim 12 wherein the recessed regions are shaped and configured for receiving angled stirrup leathers.

14. A two-person saddle as set forth in claim 12 further comprising stirrup receiving connectors secured to the tree bars generally forward of the front cantle, said stirrup receiving connectors being configured for connecting forward stirrup leathers to the tree bars.

15. A two-person saddle as set forth in claim 11 wherein the tree fork includes first and second side recessed regions for accommodating the legs of a rider sitting between the front cantle and tree fork.

16. A two-person saddle as set forth in claim 11 wherein said tree bars are of wood.

17. A two-person saddle as set forth in claim 16 wherein the tree fork, front cantle, and rear cantle are of wood.

18. A two-person saddle as set forth in claim 17 further comprising a rawhide covering over the tree bars, tree fork, front cantle, and rearward cantle.

19. A two-person saddle as set forth in claim 18 further comprising a polyurethane coating on the rawhide.

20. A two-person saddle as set forth in claim 11 further comprising a rawhide covering over the tree bars, tree fork, front cantle, and rearward cantle.

* * * * *